United States Patent [19]

Dubach

[11] Patent Number: 4,699,283

[45] Date of Patent: Oct. 13, 1987

[54] PLASTIC STOPPER WITH A SNAP HINGE

[75] Inventor: Werner F. Dubach, Maur, Switzerland

[73] Assignee: Alfatechnic AG, Dietliken, Switzerland

[21] Appl. No.: 849,110

[22] Filed: Apr. 7, 1986

[30] Foreign Application Priority Data

Apr. 15, 1985 [CH] Switzerland ..... 1592/85

[51] Int. Cl.[4] ..... B65D 41/04

[52] U.S. Cl. ..... 215/237

[58] Field of Search ..... 215/235, 237, 245, 244; 220/339, 335; 222/498, 517, 556

[56] References Cited

U.S. PATENT DOCUMENTS

| | | | |
|---|---|---|---|
| 3,323,671 | 6/1967 | Minarik | 215/237 |
| 4,358,032 | 11/1982 | Libit | 222/498 |
| 4,386,714 | 6/1983 | Roberto et al. | 215/235 X |

*Primary Examiner*—Donald F. Norton

*Attorney, Agent, or Firm*—Lee, Smith & Zickert

[57] ABSTRACT

A stopper incorporates a base (1) with a pouring opening (15) and a one-piece cap (2) divided into two sections. The cap (2) is connected to the base (1) through a flexible-strip hinge (3). The part (20) of the cap (2) closer to the flexible-strip hinge (3) and the part (21) further from the hinge are connected to each other through a snap hinge (4). There is at least one opening (17) in the base (1) in which a matching catch (26) on the part (20) engages, whereas the part can still be opened and closed freely through the snap hinge (4).

5 Claims, 10 Drawing Figures

Fig. 1
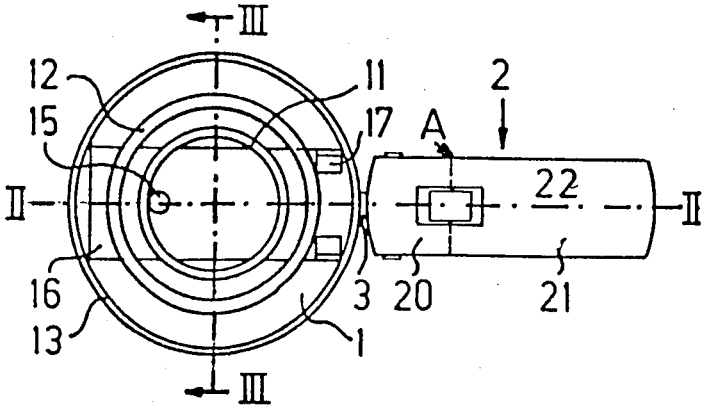
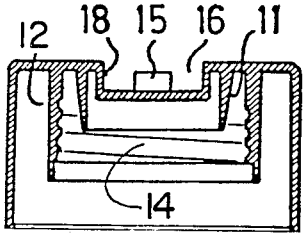
Fig.3
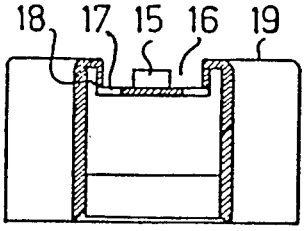
Fig. 4
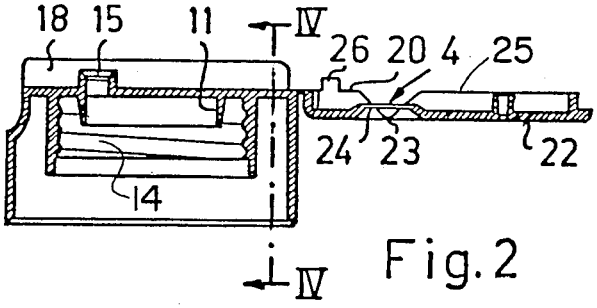
Fig. 2
Fig. 5
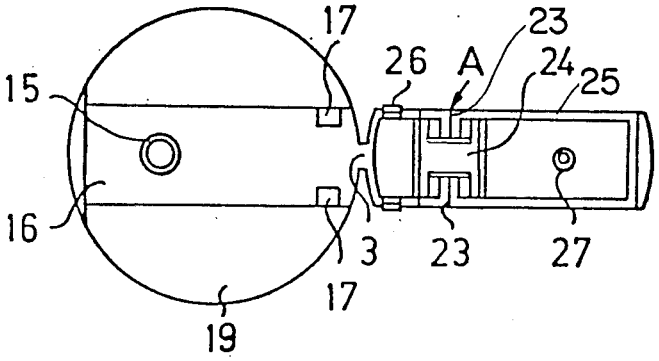

PLASTIC STOPPER WITH A SNAP HINGE

The present invention relates to a plastic stopper with a snap hinge, intended for use with rigid and deformable containers, and having a base with a pouring opening and a cap connected rigidly to the base through a flexible-strip hinge.

Numerous versions of caps of the type described above are known. However, these can be divided into two basic forms, namely, stoppers with a hinge in the side surfaces of the outer casing, as is described, for example, in DE-GM 8416 037 or WO 82/02532 (Weisinger), or stoppers with a hinge which extends beyond the side surfaces of the outer casing into the cover surface of the cap. The latter version has an elastically deformable L-lever, of which one arm is hinged into the cover surface of the cap with at least one flexible-strip hinge between the cap and the base (U.S. Pat. No. 4,386,714).

All of the snap-hinge stoppers of the kind described above are injection molded in one piece in the fully-open state. The stoppers have to be oriented and closed in a closing machine, in a second separate stage of the process, and installed on a container.

Some of the known plastic stoppers with snap hinges cannot be closed in, or immediately after being removed from, the injection mold, since the elastic parts of the snap hinge then becomes deformed in the closing process.

Closing a container is an extremely complex process as many plastic stoppers have complicated shapes and must therefore be properly oriented before they can be gripped by the processing machinery. Frequently, stoppages of the machine result.

It is an object of the present invention to create a stopper of the kind described above, which has a smooth side surface and permits simple subsequent processing.

In accordance with the invention, there is provided a plastic stopper for use with a container, comprising a base with a pouring opening for material to be dispensed from the container and a cap connectable to the base through a flexible strip hinge, said cap comprising a first part and a second part, and a snap hinge dividing said first and second parts, the first part of the cap being closer to the flexible strip hinge at least one catch for limitedly releasably connecting said one part to the base, and said second part of said cap releasably closing said pouring opening by way of said snap hinge.

A stopper configured in this way can be closed in the mold or during removal from the mold without stressing the snap hinge. The only movement is in the flexible-strip hinge between the cap and the base.

An especially flat version can be achieved where the snap hinge comprises two side flexible strip hinges lying in the upper surface of the cap, with a connector strip between the hinges which is displaced inwardly from the surface of the cap.

If the stopper is quite large, relatively great forces can be applied to the cap, and it is then advantageous if the locking element is at least a spike- or hook-shaped part on the cap, which locks positively in an opening in the base.

Preferred embodiments of the invention are described with reference to the accompanying drawings wherein, FIG. 1 shows a plastic stopper embodying the present invention, the base being seen from below, the cap from above.

FIG. 2 shows the stopper of FIG. 1 in cross-section on the line II—II.

FIG. 3 shows the stopper of FIG. 1, the cross-section being on the line III—III.

FIG. 4 is a view of the stopper in cross-section on the line IV—IV of FIG. 2.

FIG. 5 is a view of the stopper in the open position as it is injection molded, the base is seen from above, the cap from below.

Figure 6:
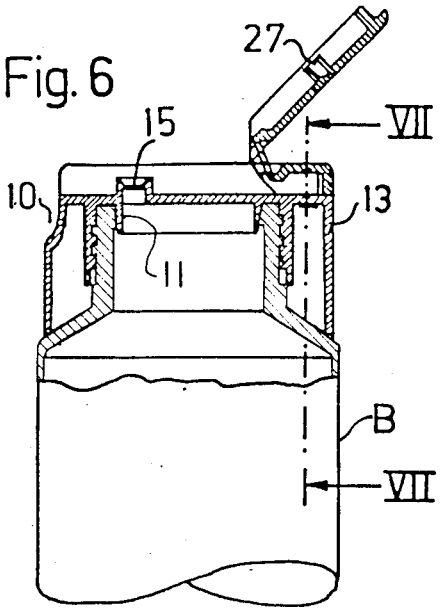
FIGS. 6 to 9 show the same, new stopper installed on a tube.

FIG. 6 being a side view partly in section with the two-piece cap of the stopper shown partially closed.

Figure 7:
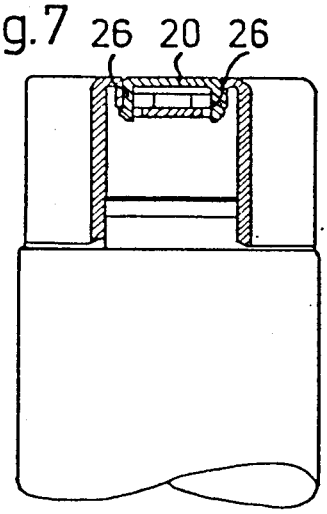

FIG. 7 is a section through the closed portion of the stopper on the line VII—VII of FIG. 6.

Figure 8:
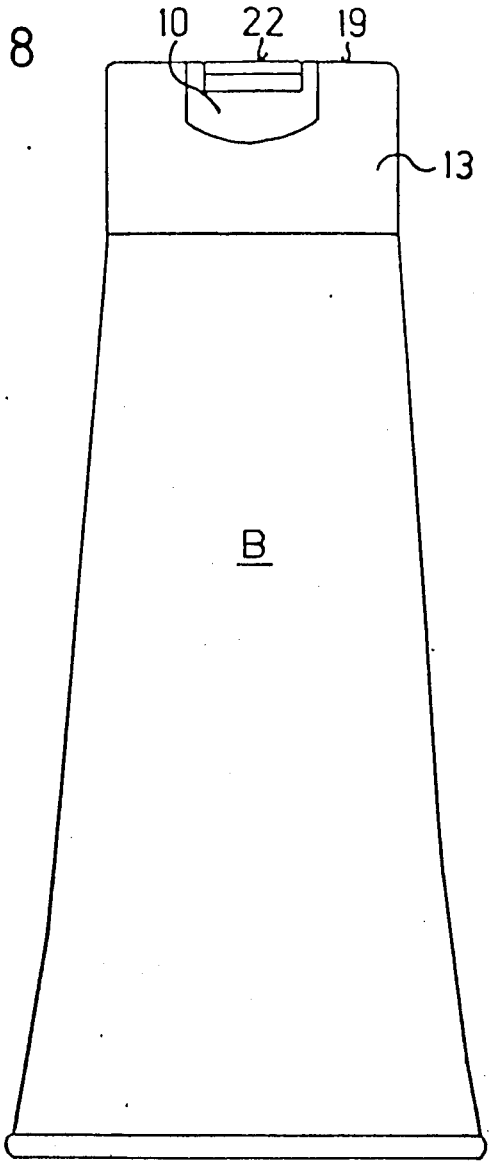

FIG. 8 is an end view partly in section of the closed stopper installed on a tube.

Figure 9:
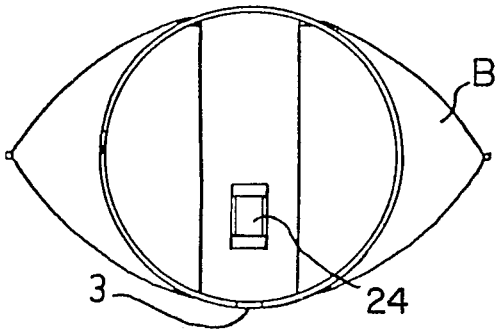

FIG. 9 is the device of FIG. 8, viewed from above.

Figure 10:
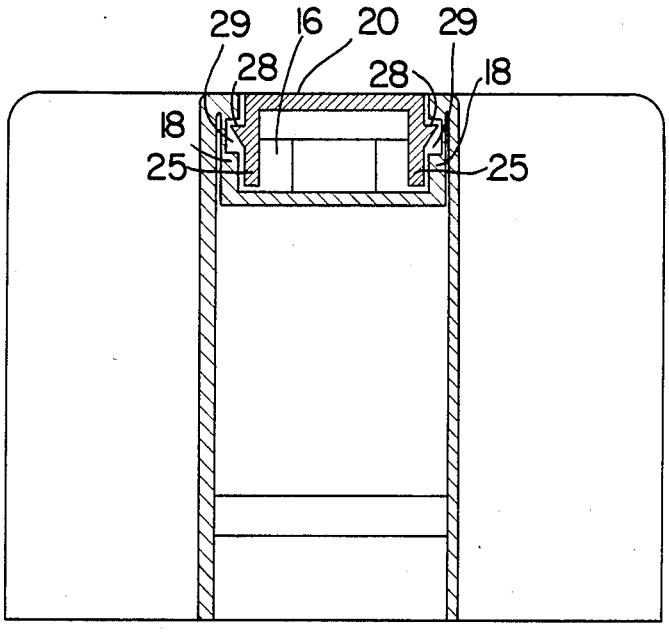

FIG. 10 is a section through the closed portion of the stopper on the line VII—VII of FIG. 6 in an alternate embodiment for the connection between the cap and the base.

As seen in the drawings, the plastic stopper consists of two main parts, base 1 and cap 2. The base 1 and the cap 2 are joined to each other through a relatively narrow flexible strip hinge 3. There are three concentric, annular walls in the base 1. The inntermost wall 11 is a sealing ring which, in cross-section, tapers down towards its lower part. This ring serves to seal the container concerned against the lower portion of the stopper (see also FIG. 6). The middle annular wall 12 serves to secure the plastic stopper to the container to be sealed. This can be either a clamping or squeeze-type bead or, as in the example shown, can be an inside thread 14. The outermost annular ring is the outside surface casing of the stopper and provides aesthetic shape and serves to harmonize the appearance of the stopper with that of the container B and imparts additional strength and firmness to the stopper (see FIGS. 6 to 9). The base 1 has a pouring opening 15 for the material in the container within the inner annular wall 11.

A U-shaped groove 16 of rectangular cross-section traverses the base 1 diametrically and passes centrally to the flexible film hinge 3 transversely across the base. The depth of groove 16 corresponds to the height of the cap 2. Formed in the base of the groove, between the middle annular wall 12 and the outermost annular wall 13, are two openings 17, in the area close to the flexible strip hinge 3 between the cap 2 and the base 1 (FIGS. 1, 4 and 5). The openings 17 are located as close as possible to the side walls 18 of the groove 16.

In the example shown, the two-part cap 2, connected rigidly to the base 1 so as to form one unit, is configured as a beam. The division of the cap 2 into its two sections cannot be seen from above (FIGS. 1 and 9). In FIG. 1 only the pivot axis A is shown as a dashed line for purposes of clarity. From the side in FIG. 2 it is clear how part 20 of the cap 2 which is closest to the flexible strip hinge 3 and the part 21 of the cap which is furthest from the strip 3 are constructed. When the stopper is closed, the surface 22 of the cap is flush with and parallel to the surface 19 of the base (FIG. 8). The area of part 20 of the cap 2 is much smaller than the area of part 21. Parts 20 and 21 of the cap are connected to one another so as to form one piece by a snap hinge 4.

The snap hinge 4 is so constructed that the cross-section of the cap 2 tapers down on each part 20 and 21 as a wedge-shape (see FIG. 2) to a flexible strip hinge 23 on both sides at the axis of pivot A. Between the two flexible strip hinges 23 in the surface 22 of the cap 2 is a connector strip 24. In contrast to the plane of the surface 22, the connector strip is offset inwards, parallel to the surface 22. In the extended position, in which the cap is extruded, the connector strip 24 is unstressed.

The cap 2 is surrounded by an edge 25 of height equal to the depth of the groove 16. Hook-shaped latches 26 are formed in the area of the cap edge 25 adjacent to the flexible strip hinge 3, to connect between the cap 2 and the base 1. When the stopper 1 is closed, the latches 26 engage in the openings 17 in the base 1 and hook onto its underside. It is subsequently impossible to open the rear part 20 of the cap 2 without special manipulation (See FIGS. 6 and 7). On the other hand, the front part 21 of the cap can be opened easily by way of the snap hinge 4. Flexible strip hinge 3 only fulfills an auxiliary function during the first closing process of the total cap 2 described above. Once closed, the hinge 3 has no further function. The closing function for the container is then fulfilled by part 21 of the cap, which extends beyond the opening 15 in the base, and has a plug-like sealing element 27, the shape of which matches the opening 15.

A relief notch 10 in the base 1 provides for easier operation of the cap part 21 wherein the finger-tip can be introduced below the part 21 so that it can be easily raised.

The stopper is injection molded in the position shown in FIG. 1, and can be closed by simply being pivoted about the flexible-strip hinge 3, without operating the snap hinge 4. This can be done, for instance, directly after the mold is opened so that then the closed stopper can be ejected from the mold. There is thus no need for subsequent orientation and expense of closing of the stopper in special machinery.

Different variations are conceivable in addition to the preferred embodiment set out above. Thus, for example, in place of the two lateral, hook-shaped catches 26 on the cap portion 20, there could be only one central hook- , or spike-like, part that would then engage in a corresponding opening 17.

From the sectional view of an alternate embodiment shown in FIG. 10, it will be seen that the connection between the cap portion 20 and the base 1, which is only limitedly releasable, can, however, be by means of angular beads 28 on the side edges 25 of the cap portion 20, which then engage in corresponding grooves 29 in the side walls 18 of the groove 16. This kind of arrangement can also be usefully applied in the front part 21 of the cap, so as to achieve a certain, albeit easy to release, detent action of the part that is to be opened.

The snap hinge 4 can also be configured differently. In place of the one connector strip 24, there can be two parallel strips. This will divide the flexible-strip hinge 23 into three parts which will, however, be flush with one another.

Neither the specific shape of the cap nor the shape of the base, nor the configuration of the flexible-strip hinge 23 as described is to be considered limiting. Thus, the cap can cover the whole of the base, and the cap can be divided into exact halves. However, the displacement of the snap hinge from the area of the direct connection between the cap and the base is important. This allows the formation of the only limited releasable connection between the base and the fixed portion of the cap.

The embodiments of the invention in which an exclusive property or privilege is claimed are defined as follows:

1. A plastic stopper for use with a container, comprising a base with a pouring opening for material to be dispensed from the container and a cap connected to the base through a flexible strip hinge, said cap comprising a first part and a second part, and a snap hinge dividing said first and second parts, the first part of the cap being closer to the flexible strip hinge, the snap hinge comprising at least two flexible-strip hinges lying in the surface of the cap and at least one connector strip between said first and second parts inwardly offset from the level of the cap surface, at least one catch for releasably connecting said first part to the base, and said second part of said cap releasably closing said pouring opening by way of said snap hinge.

2. A plastic stopper as in claim 1, characterized in that the catch is a hook-shaped part, that engages positively in an opening in the base.

3. A plastic stopper as in claim 1, characterized in that the cap is in the form of a beam that fits positively within a groove in the base.

4. A plastic stopper as in claim 3, characterized in that at least the first part of said cap has side beads engageable in matching grooves in side walls of the groove.

5. A plastic stopper as defined in claim 1, said snap hinge having a hinge axis parallel to an axis of hinging of said flexible strip hinge.

* * * * *